US007573445B2

(12) United States Patent
Machida

(10) Patent No.: US 7,573,445 B2
(45) Date of Patent: Aug. 11, 2009

(54) DRIVING METHOD OF LIGHT EMITTING DEVICE AND ELECTRONIC APPARATUS

(75) Inventor: Asami Machida, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 445 days.

(21) Appl. No.: 10/732,602

(22) Filed: Dec. 10, 2003

(65) Prior Publication Data

US 2004/0246208 A1 Dec. 9, 2004

(30) Foreign Application Priority Data

Dec. 19, 2002 (JP) ..... 2002-368916

(51) Int. Cl.
*G09G 3/30* (2006.01)

(52) U.S. Cl. ..... 345/77; 345/82; 345/690

(58) Field of Classification Search ..... 345/76–83, 345/87, 55, 204, 690–693; 315/169.1–169.4
See application file for complete search history.

(56) References Cited

U.S. PATENT DOCUMENTS

| | | | | |
|---|---|---|---|---|
| 5,793,163 | A | 8/1998 | Okuda | 315/169.2 |
| 6,229,506 | B1 | 5/2001 | Dawson et al. | 345/82 |
| 6,246,384 | B1 * | 6/2001 | Sano | 345/76 |
| 6,583,775 | B1 | 6/2003 | Sekiya et al. | |
| 6,646,654 | B2 | 11/2003 | Takagi | 345/690 |
| 7,113,154 | B1 | 9/2006 | Inuaki | |
| 7,259,735 | B2 * | 8/2007 | Kasai | 345/77 |
| 7,283,108 | B2 * | 10/2007 | Kasai | 345/76 |
| 2001/0040536 | A1 * | 11/2001 | Tajima et al. | 345/55 |
| 2002/0012008 | A1 | 1/2002 | Takagi | 345/691 |
| 2002/0101394 | A1 * | 8/2002 | Anzai | 345/76 |
| 2003/0112208 | A1 * | 6/2003 | Okabe et al. | 345/82 |
| 2004/0150595 | A1 | 8/2004 | Kasai | |
| 2007/0257867 | A1 | 11/2007 | Kasai | |
| 2007/0257868 | A1 | 11/2007 | Kasai | |

FOREIGN PATENT DOCUMENTS

| | | | |
|---|---|---|---|
| EP | 0 766 221 | A1 | 4/1997 |
| EP | 1 061 497 | A1 | 12/2000 |
| EP | 1 429 312 | A2 | 6/2004 |

(Continued)

OTHER PUBLICATIONS

International Search Report re International Application No. PCT/JP03/15618, mailed Feb. 24, 2004.

(Continued)

*Primary Examiner*—Amr Awad
*Assistant Examiner*—Stephen G. Sherman
(74) *Attorney, Agent, or Firm*—Cook Alex Ltd.

(57) ABSTRACT

A light emitting element deteriorates with time. Therefore, a method for reducing a lighting time is suggested to obtain a long life light emitting element. However, when the proportion (duty ratio) that a lighting time occupies per one horizontal scan period is reduced, the apparent luminance is also lowered. According to the invention, a light emitting element is controlled so that a light emitting period 205 and a non-light emitting period 206 are switched alternately at least once during a sustain period 203 in synchronism with a control signal. Thus, instantaneous lighting time can be reduced enough to reduce the duty ratio while maintaining the apparent luminance.

11 Claims, 6 Drawing Sheets

FOREIGN PATENT DOCUMENTS

| | | | |
|---|---|---|---|
| EP | 1 870 875 | A2 | 12/2007 |
| JP | 04-137392 | | 5/1992 |
| JP | 05-232900 | | 9/1993 |
| JP | 7-287247 | | 10/1995 |
| JP | 09-097925 | | 4/1997 |
| JP | 2000-347622 | | 12/2000 |
| JP | 2001-042822 | | 2/2001 |
| JP | 2001-308710 | | 11/2001 |
| JP | 2002-221938 | | 8/2002 |
| JP | 2002-345811 | | 8/2002 |
| JP | 2003-076325 | | 3/2003 |
| WO | WO 98/48403 | | 10/1998 |

OTHER PUBLICATIONS

European Search Report re application No. EP 03777307.4, dated Oct. 13, 2008.

* cited by examiner

DRIVING METHOD OF LIGHT EMITTING DEVICE AND ELECTRONIC APPARATUS

TECHNICAL FIELD

The present invention relates to a driving method of a light emitting device.

BACKGROUND ART

In recent years, a light emitting device in which a light emitting element typified by an electro luminescence (EL) element and the like is used in a pixel portion instead of a liquid crystal element has been actively developed for flat panel displays. A light emitting device requires no light source such as a back light, therefore, it has the advantages that moving pictures can be displayed with fast response, viewing angle is wide and the like as well as the advantages of low power consumption, small size and light weight. Accordingly, the light emitting device attracts attention for laptop flat panel displays of the next generation, which will provide full color moving pictures.

A light emitting element included in each pixel degrades with time. As a measure against the degradation of a light emitting element with time, for example, in order to improve a reliability of a light emitting element, a technology for controlling light emitting time of a pixel is disclosed (see Patent Document 1 for example). More specifically, a "black" is displayed by an analog video signal, or two electrodes connected to a light emitting element are set at the same potential so that the light emitting element is made in a non-light emitting state.

[Patent Document 1]
Japanese Patent Laid-Open No. 2002-087070

DISCLOSURE OF THE INVENTION

The Problems to be Solved by the Invention

According to the aforementioned technology, however, light emitting time of a light emitting element can not be shortened enough. Further, a power supply voltage which supplies a current to the light emitting element is required to vary, thus an external circuit gets overloaded. In addition, when the proportion (duty ratio) that the light emitting time occupies per one horizontal scan period is reduced, the apparent luminance is also lowered.

In view of the foregoing, it is a general object of the invention to provide a long life light emitting element by using a new configuration.

Means for Solving the Problems

In order to solve the above-mentioned problems, the invention provides a driving method of a light emitting device, comprising a non-light emitting period of a pixel in a frame period, and in particular, the driving method of a light emitting device in which the light emitting element is forced to flash, that is, alternate a light emission and a non-light emission, in synchronism with a control signal.

According to a driving method of a light emitting device of the invention, the light emitting device comprises a plurality of pixels each having a light emitting means for emitting light by a current, a driving means for supplying a current to the light emitting means in accordance with a video signal, a first setting means for setting n (n is a natural number equal to or more than one) sustain periods in a frame period, a second setting means for setting a non-light emitting period of the light emitting means, and a third setting means for flashing the light emitting means in synchronism with a control signal inputted from outside. In the n sustain periods, a current is supplied to the light emitting means in accordance with the video signal and the light emitting means is flashed by the third setting means which operates in synchronism with a control signal inputted from outside.

Needless to say, to be flashed means here that a light emission and a non-light emission are alternated.

The light emitting means described above corresponds to a light emitting element, and more specifically, a light emitting element formed of various materials such as an organic material, an inorganic material, a thin film material, a bulk material, and a dispersion material. The light emitting element comprises an anode, a cathode, and a light emitting layer interposed between the anode and the cathode. The light emitting layer is formed of one or a plurality of materials selected from the above-mentioned materials.

The driving means described above corresponds to an element connected to the light emitting means, and more specifically, a transistor connected to the light emitting means.

The first setting means and the second setting means described above correspond to elements disposed in a pixel, and more specifically, elements capable of controlling a signal input to the pixel. Further, the first and the second setting means correspond to a scan line driver circuit, a signal line driver circuit and the like which are disposed at the periphery of the pixel.

The third setting means described above corresponds to a switch interposed between the light emitting means and the driving means, a control circuit for controlling the switch, and the like.

It is to be noted that an independent means may be used for each of the first setting means, the second setting means, and the third setting means, or a means having multiple functions may be used in common.

Furthermore, for the control signal, a clock signal for controlling a scan line driver circuit may be used.

According to the invention, a sustain period starts in accordance with a signal inputted from a first scan line, thereby a light emitting element emits light. The light emitting element is repeatedly flashed during the sustain period in accordance with a control signal inputted from outside. The sustain period terminates in accordance with a signal inputted from a second scan line, thereby the light emitting element emits no light.

Also, a sustain period starts by inputting an input signal from a first scan line to a first TFT, and a current corresponding to a video signal is supplied to a light emitting element by a driving TFT, thereby the light emitting element emits light. The light emitting element is repeatedly flashed by inputting a control signal from outside to a second TFT during the sustain period. The sustain period terminates by inputting an input signal from a second scan line to the second TFT, thereby the light emitting element turns off.

A sustain period starts by inputting an input signal from a first scan line to a first TFT, and a current corresponding to a video signal is supplied to a light emitting element by a driving TFT, thereby the light emitting element emits light. The light emitting element is repeatedly flashed during the sustain period by inputting a control signal from outside to a third TFT. The sustain period terminates by inputting an input signal from a second scan line to the second TFT, thereby the light emitting element turns off.

EFFECT OF THE INVENTION

According to the driving method of a light emitting device of the invention, deterioration with time of a light emitting element can be prevented by repeatedly alternating a light emission and a non-light emission of the light emitting element and shortening the light emitting time thereof, leading to improved reliability of the light emitting element. Further, instantaneous lighting time of the light emitting element can be reduced enough to reduce the duty ratio while maintaining the apparent luminance.

BEST MODE FOR CARRYING OUT THE INVENTION

The embodiment mode of the present invention will be explained below.

Embodiment Mode 1

Figure 1:
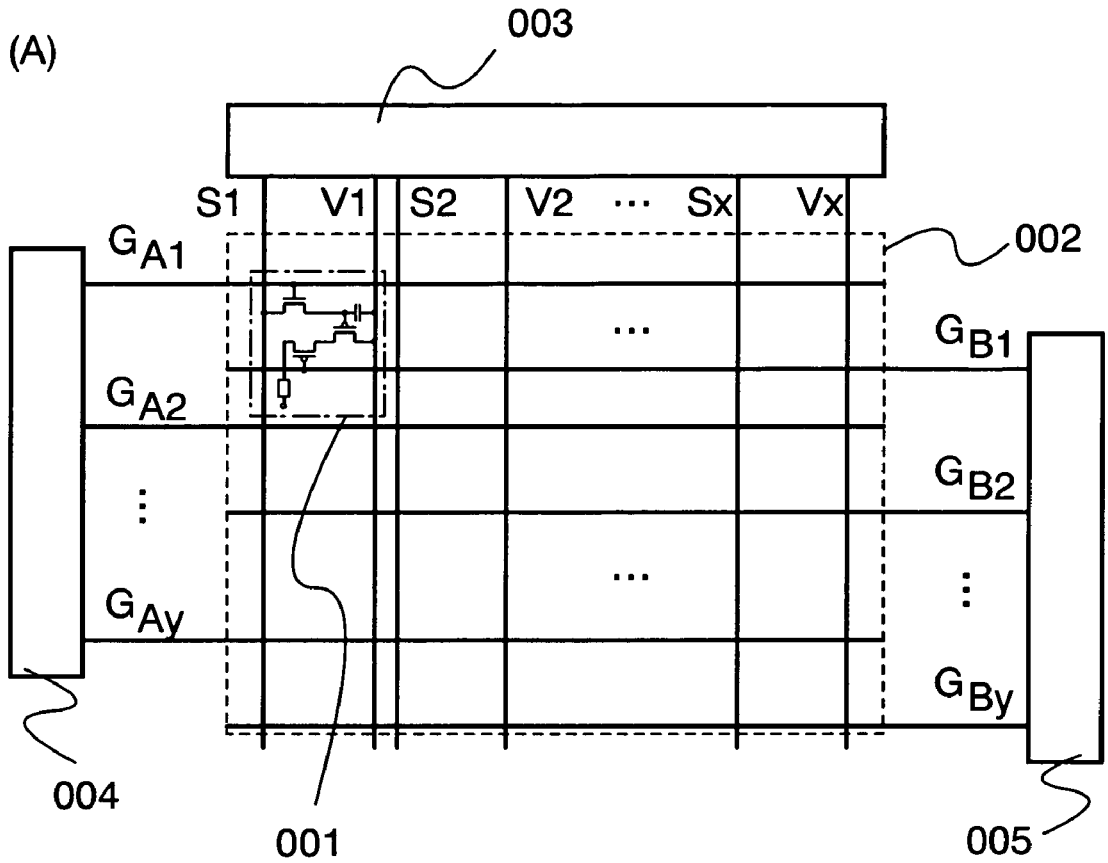
FIG. 1 shows diagrams for explaining a light emitting device of the invention.
Figure 1:
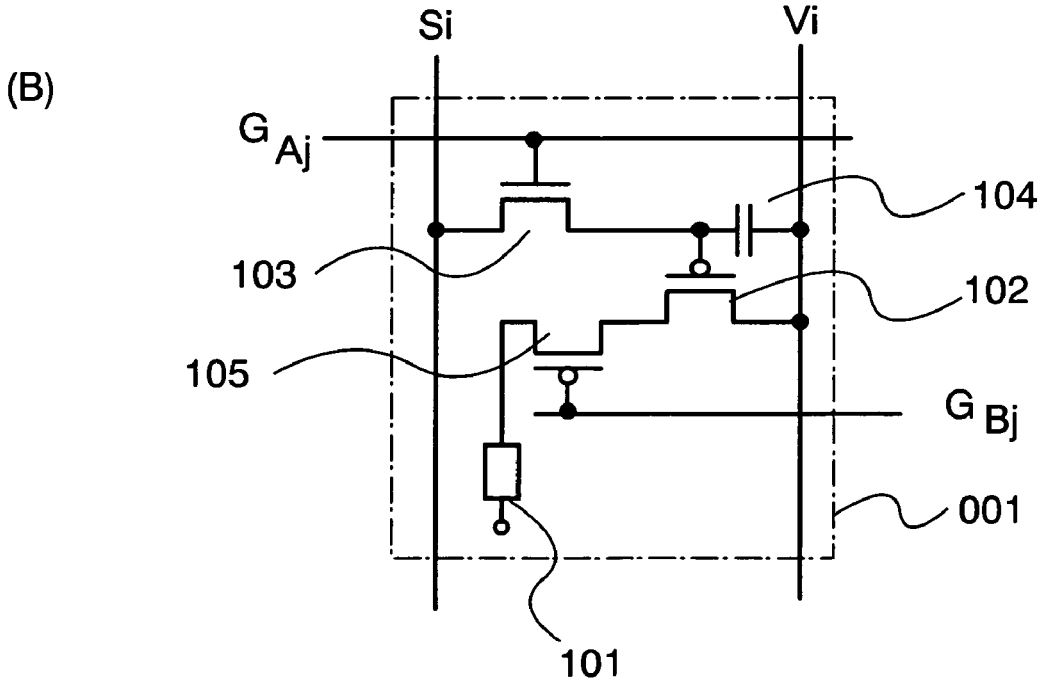

In this embodiment mode, a configuration example of a light emitting device to which the invention is applied will be explained with reference to FIG. 1. Then, a driving method of the light emitting device of the invention will be described with reference to FIG. 2 and FIG. 3.

FIG. 1A is a schematic diagram of a light emitting device. The light emitting device comprises a pixel portion 002, as well as a signal line driver circuit 003, a first scan line driver circuit 004 and a second scan line driver circuit 005 which are disposed at the periphery of the pixel portion 002.

The pixel portion 002 includes x signal lines $S_1$ to $S_x$ and x power supply lines $V_1$ to $V_x$, which are arranged in columns, and y first scan lines $G_{A1}$ to $G_{Ay}$ and y second scan lines $G_{B1}$ to $G_{By}$, which are arranged in rows (x and y are natural numbers). An area surrounded by each one of the signal lines $S_1$ to $S_x$, the power supply lines $V_1$ to $V_x$, the first scan lines $G_{A1}$ to $G_{Ay}$, and the second scan lines $G_{B1}$ to $G_{By}$ corresponds to a pixel 001. In the pixel portion, a plurality of pixels are arranged in matrix.

The signal line driver circuit 003, the first scan line driver circuit 004, the second scan line driver circuit 005 and the like may be integrally formed on the same substrate. Further, the number of the signal line driver circuit 003, the first scan line driver circuit 004 and the second scan line driver circuit 005 can be determined arbitrarily depending on the configuration of the pixel 001. Although not shown, a signal is supplied from outside to the signal line driver circuit 003, the first scan line driver circuit 004, and the second scan line driver circuit 005 through a flexible printed circuit (FPC).

With reference to FIG. 1B, a configuration of the pixel 001 which is disposed in the i-th column and the j-th row will be described in detail. The pixel 001 comprises a first switching transistor 103, a second switching transistor 105, a driving transistor 102, a capacitor 104, and a light emitting element 101.

The gate electrode of the first switching transistor 103 is connected to a first scan line $G_{Aj}$, the first electrode is connected to a signal line $S_i$, and the second electrode is connected to the gate electrode of the driving transistor 102.

The first electrode of the driving transistor 102 is connected to a power supply line $V_i$, and the second electrode is connected in series with the second switching transistor 105. The gate electrode of the second switching transistor 105 is connected to a second scan line $G_{Bj}$, and the other end is connected to one electrode of the light emitting element 101.

One end of the capacitor 104 is connected to the power supply line $V_i$, and the other side thereof is connected to the signal line $S_i$ through the first switching transistor 103, as well as to the gate electrode of the driving transistor 102. Therefore, a signal voltage inputted from the signal line $S_i$ is stored in the capacitor 104, and a voltage between the gate and the source of the driving transistor 102 is retained even after stopping applying a voltage to the signal line $S_i$.

One end of the first scan line $G_A$ is connected to the first scan line driver circuit 004 and one end of the second scan line $G_B$ is connected to the second scan line driver circuit 005, each of which is applied a predetermined scan voltage.

The first switching transistor 103 and the second switching transistor 105 control a signal input to the pixel 001. Accordingly, the first switching transistor 103 and the second switching transistor 105 have only to perform a switching function, thus their conductivity is not especially limited.

Although the capacitor 104 is provided in the pixel 001, the invention is not limited to this. A gate capacitance or a channel capacitance of the driving transistor 102 may be used instead. Alternatively, a parasitic capacitance generated due to wirings and the like may be used as well.

Figure 2:
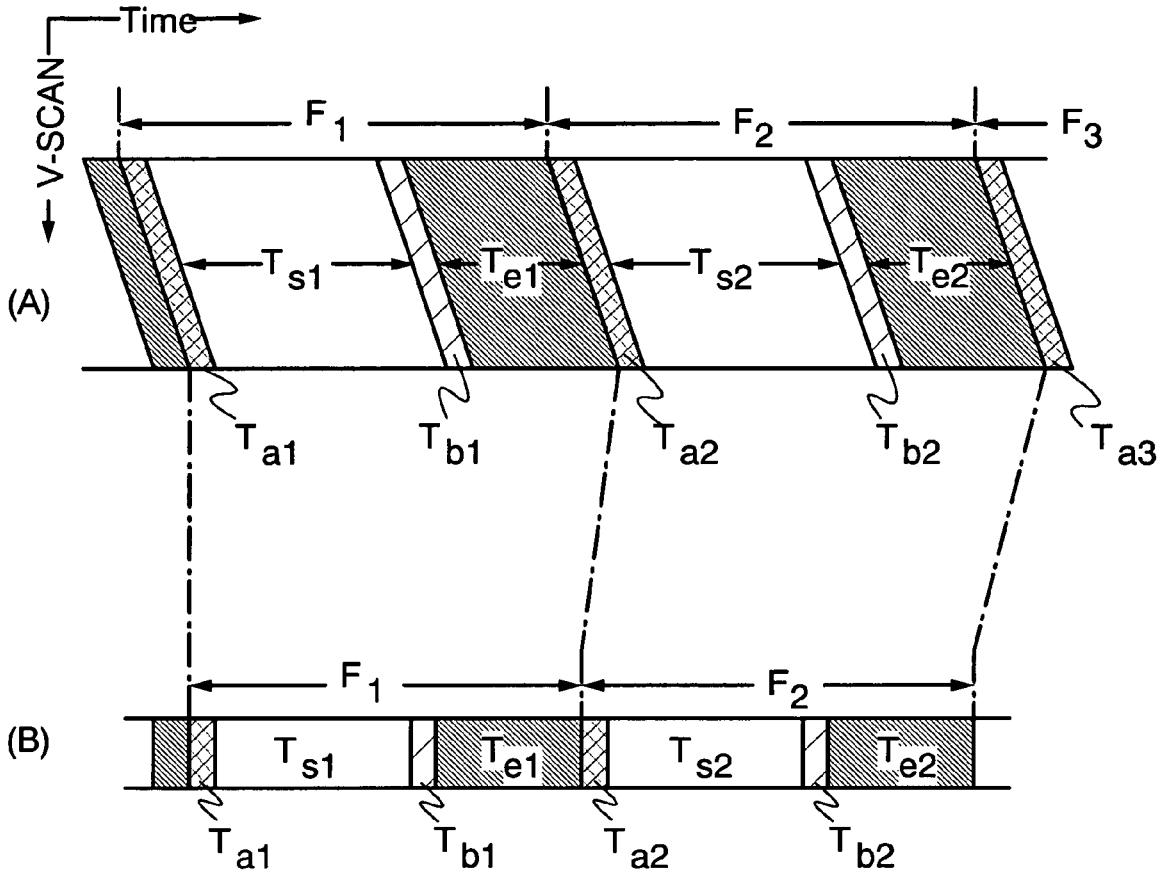
FIG. 2 shows diagrams for explaining a driving method of a light emitting device of the invention.

In FIG. 2, the abscissa axis represents time whereas the ordinate axis represents a scan line. Each frame period (F) corresponds to the period from an input of a video signal until an input of the next video signal in each pixel.

As shown in FIG. 2A, each frame period is divided into an address period during which a video signal is inputted to a pixel, and a sustain period ($T_s$) during which a pixel emits light in accordance with the video signal. The address period includes a first address period ($T_a$) and a second address period ($T_b$). The first scan lines $G_{A1}$ to $G_{Ay}$ are selected during the first address period ($T_a$), and the second scan lines $G_{B1}$ to $G_{By}$ are selected during the second address period ($T_b$). FIG. 2B shows a timing chart of one scan line.

It is to be noted that in the invention, application of a video signal to the gate electrode of the driving transistor 102 is described as a video signal input to the pixel 001.

First, during a first address period ($T_a$) in the first frame period ($F_1$), a first scan line $G_{A1}$ is selected in accordance with a signal inputted from the first scan line driver circuit 004, thereby turning ON the first switching transistors 103 of all the pixels 001 connected to the first scan line $G_{A1}$. Subsequently, the pixels in the first row are scanned line by line through the signal lines $S_1$ to $S_x$ controlled by the signal line driver circuit 003. Then, a video signal is sequentially inputted to the pixels 001 from the first row to the x-th (final) row, and the pixels 001 emit light in accordance with the video signal. More specifically, the video signal is inputted to the gate electrode of the driving transistor 102 through the first switching transistor 103 in the pixel 001. In accordance with a potential of the inputted video signal, a voltage between the gate and the source of the driving transistor 102 is determined, and then a current flowing between the source and the drain of the driving transistor 102 is determined as well. This current is supplied to the light emitting element 101, and thus the light emitting element 101 emits light.

In such a manner, the light emitting elements 101 emit light when the video signals are inputted to all the pixels 001 in the first row. Thus, a sustain period ($T_s$) starts in all the pixels 001 in the first row.

During the sustain period ($T_s$), a control signal, for example a rectangular signal, a clock signal for controlling the scan line driver circuit, and the like, is inputted from outside to the gate electrode of the second switching transistor 105 so that a current is supplied to the light emitting element 101 in synchronism with the control signal. According to this, the light emitting element 101 can be flashed during the sustain period ($T_s$). The control signal may be inputted from the second scan line $G_{B1}$, or from a signal line which is separately provided.

Next, during a second address period ($T_b$), a second scan line $G_{B1}$ is selected in accordance with a signal inputted from the second scan line driver circuit 005, thereby turning OFF the second switching transistors 105 of all the pixels 001 connected to the second scan line $G_{B1}$. At this time, the gate potential of the driving transistor 102 is the same as the source potential thereof. Therefore, no current is supplied to the light emitting element 101, thus the light emitting element 101 turns off.

Figure 3:
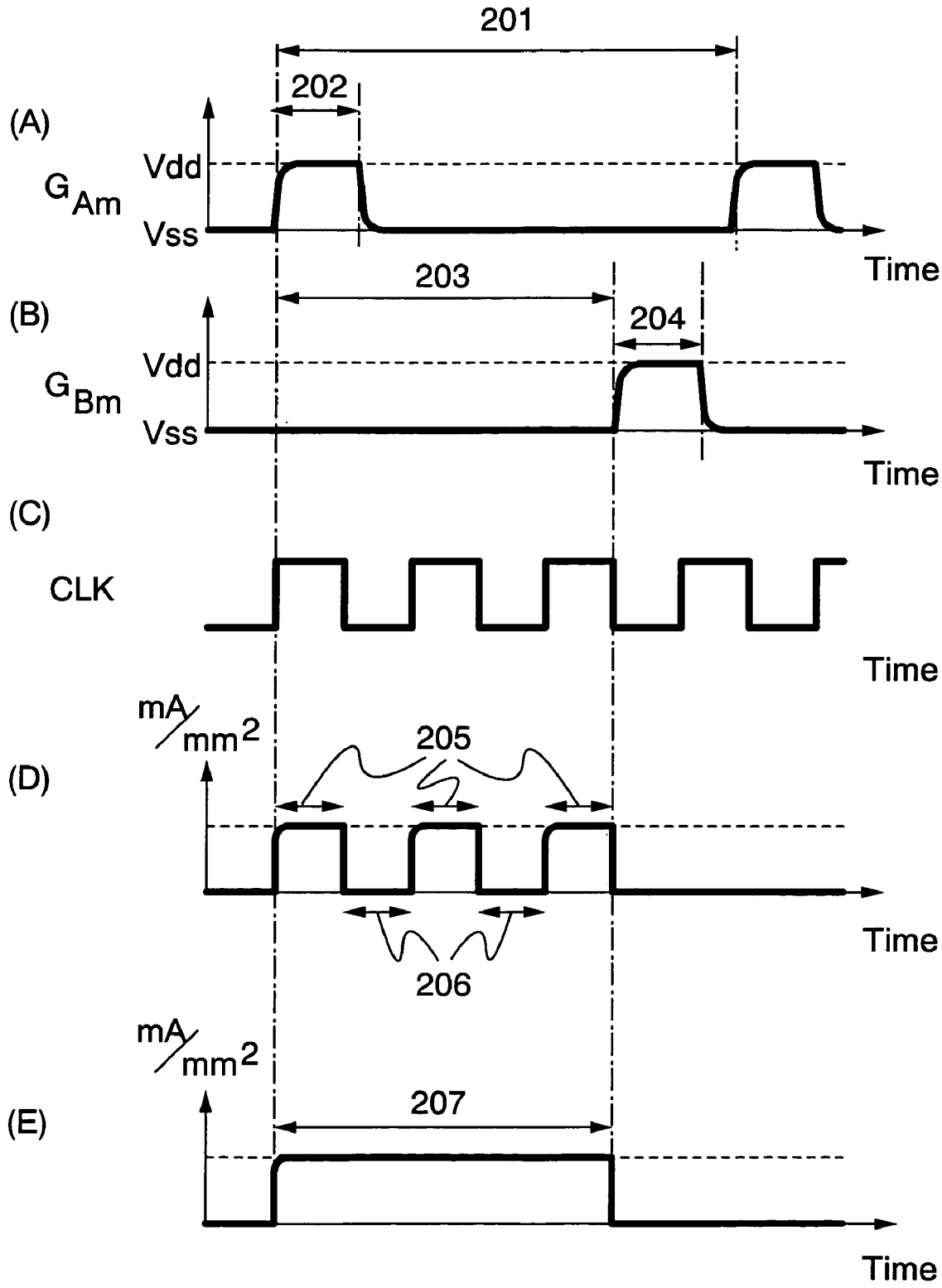
FIG. 3 shows diagrams for explaining the driving method of a light emitting device of the invention.

FIG. 3 shows voltages of a first scan line $G_{Am}$ and a second scan line $G_{Bm}$ during the sustain period ($T_s$). Their operation will be described in detail.

In FIGS. 3A and 3B, the abscissa axis represents time whereas the ordinate axis represents a voltage. FIGS. 3A and 3B respectively show a relationship between the time and the voltage of the first scan line $G_{Am}$ in the m-th row, and a relationship between the time and the voltage of the second scan line $G_{Bm}$ in the m-th row (m is a natural number; $1 \leqq m \leqq y$).

In FIGS. 3A and 3B, reference numeral 201 denotes a unit frame period. A period 202 is a first address period ($T_a$) and a period 204 is a second address period ($T_b$), each of which corresponds to one horizontal scan period. Reference numeral 203 denotes a sustain period ($T_s$).

FIG. 3C shows a control signal inputted from outside.

In FIGS. 3D and 3E, the abscissa axis represents time and the ordinate axis represents a current density. FIG. 3D shows a relationship between the time and the current density which is supplied to a pixel in the i-th row and the j-th column. Meanwhile, FIG. 3E shows a relationship between the time and the current density which is supplied to a pixel in the i-th row and the j-th column in a conventional manner.

In a conventional manner, a voltage is applied to the light emitting element 101 throughout a light emitting period ($T_e$) 207 as shown in FIG. 3E. On the other hand, according to this embodiment mode, a light emitting period 205 and a non-light emitting period 206 are switched alternately during the sustain period ($T_s$) 203 as shown in FIG. 3D. As a result, it is possible to reduce the duty ratio while maintaining the apparent luminance. Moreover, instantaneous lighting time of the light emitting element 101 can be reduced, thus a long life light emitting element 101 can be achieved.

EMBODIMENT

Embodiment 1

Figure 4:
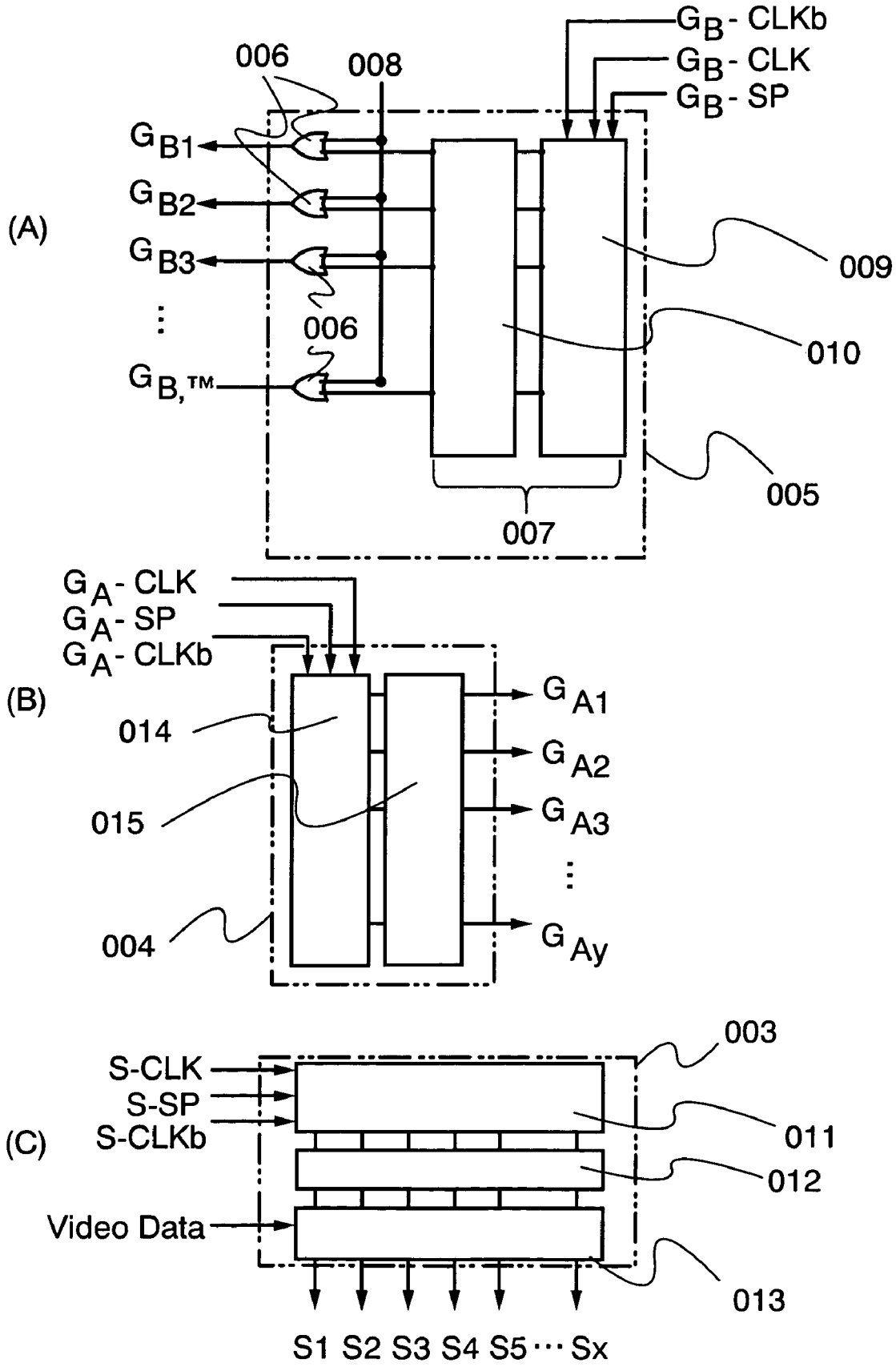
FIG. 4 shows diagrams for explaining Embodiment 1 of the invention.

With reference to FIGS. 4A to 4C, explanation will be made on configurations and operations of the signal line driver circuit 003, the first scan line driver circuit 004, and the second scan line driver circuit 005, which are mentioned in Embodiment Mode.

In FIG. 4C, the signal line driver circuit 003 comprises a shift register 011, a buffer 012, and a sampling circuit 013. The operation is briefly described below. The shift register 011 sequentially outputs a sampling pulse in accordance with a clock signal (S-CLK), a start pulse (S-SP), and a clock inversion signal (S-CLKb). Then, the sampling pulse is amplified in the buffer 012 and inputted to the sampling circuit 013. A video signal, which has been inputted to the sampling circuit 013, is inputted to the signal lines $S_1$ to $S_x$ in accordance with the timing of the input of the sampling pulse.

In FIG. 4B, the first scan line driver circuit 004 comprises a shift register 014 and a buffer 015. The operation is briefly described below. The shift register 014 sequentially outputs a sampling pulse in accordance with a clock signal ($G_A$-CLK), a start pulse ($G_A$-SP), and a clock inversion signal ($G_A$-CLKb). Afterwards, the sampling pulse is amplified in the buffer 015 and inputted to the first scan lines $G_{A1}$ to $G_{Ay}$ in order to select each of the first scan lines line by line. Then, a video signal is sequentially inputted from the signal lines $S_1$ to $S_x$ to a pixel controlled by a selected first scan line $G_{An}$, and the light emitting element 101 emits light, thereby a sustain period starts.

In FIG. 4A, the second scan line driver circuit 005 comprises a shift register 009, a buffer 010, and a switching circuit 006. The operation is briefly described below. The shift register 009 sequentially outputs a sampling pulse in accordance with a clock signal ($G_B$-CLK), a start pulse ($G_B$-SP), and a clock inversion signal ($G_B$-CLKb). Afterwards, the sampling pulse is amplified in the buffer 010 and inputted to the switching circuit 006. At the same time, a control signal 008 is inputted from outside to the switching circuit 006. A signal outputted from the switching circuit 006 sequentially selects the second scan lines $G_{B1}$ to $G_{By}$ line by line. Then, a pixel controlled by a selected second scan line $G_{Bn}$ is sequentially brought into a non-light emitting state. When a control signal is inputted from outside in a sustain period, the light emitting element 101 alternates a light emission and a non-light emission, then it is brought into a non-light emitting state with an input of a sampling pulse.

A NAND circuit is used for the switching circuit 006 in this embodiment, though, any circuit may be used as far as it has a plurality of input terminals each of which is selected in accordance with an inputted signal. Further, although the control signal 008 is inputted from outside, it may be inputted in synchronism with the clock signal ($G_B$-CLK) of circuits 007 for applying a scan voltage, or the clock signal may be branched to be inputted directly. In order to maintain the apparent luminance even when the duty ratio is lowered, the light emitting element 101 has to be flashed with a shorter period than a sustain period which has the shortest lighting time of the n sustain periods in a frame period. As the period for flashing is shortened, the flashing is not easily perceived by the human eye, though an external circuit gets overloaded at the same time. Therefore, it is preferable that an input frequency to the control signal 008 is equal to or substantially equal to the clock signal of the circuits 007 for applying a scan voltage.

Embodiment 2

Figure 5:
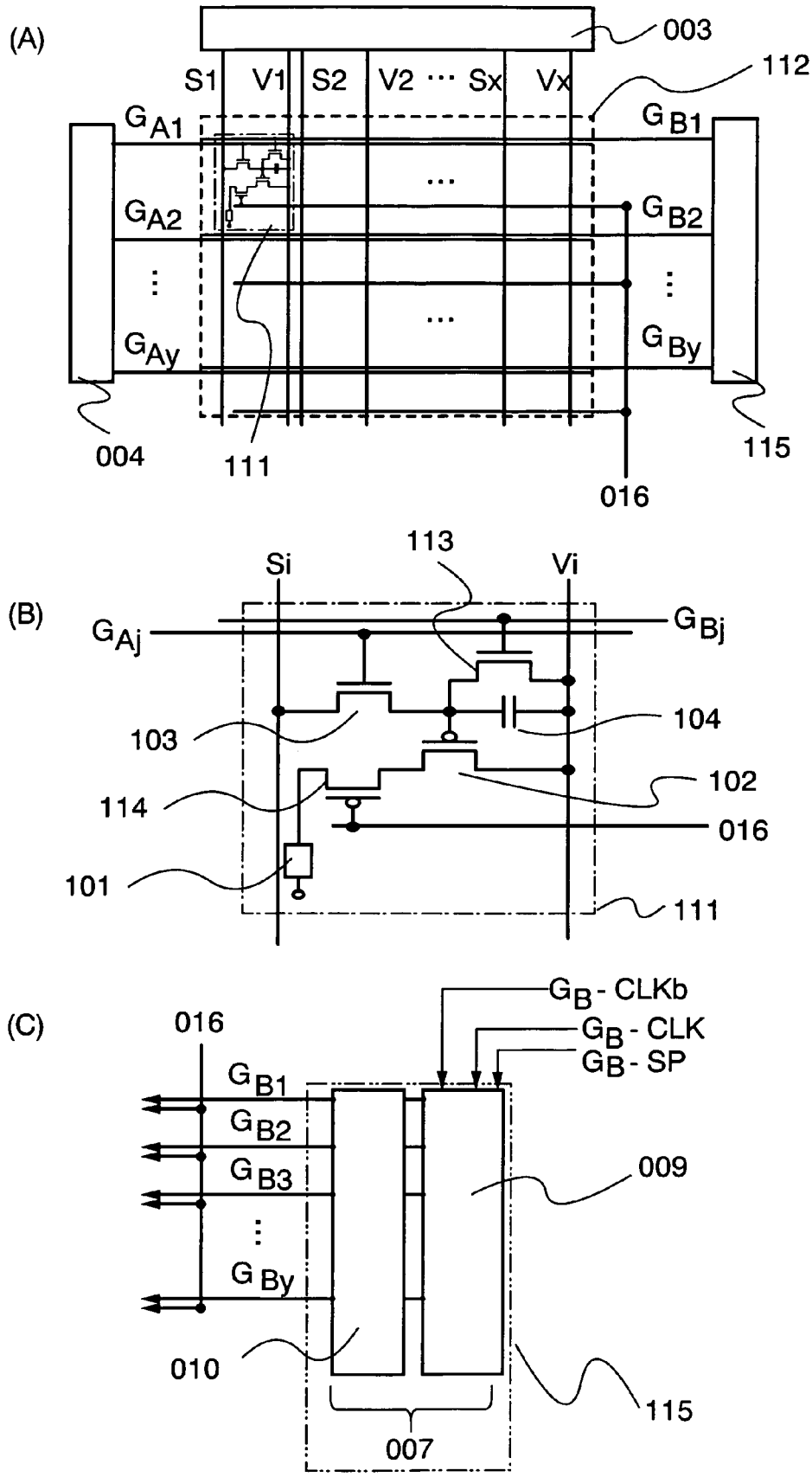
FIG. 5 shows diagrams for explaining Embodiment 2 of the invention.

With reference to FIG. 5, description is made on an embodiment in the case of using a pixel configuration different from that shown in FIG. 1B.

In FIG. 5B, a pixel 111 comprises the first switching transistor 103, a second switching transistor 113, a third switching transistor 114, the driving transistor 102, the capacitor 104, and the light emitting element 101.

The gate electrode of the first switching transistor 103 is connected to the first scan line $G_{Aj}$, the first electrode of the first switching transistor 103 is connected to the signal line $S_i$, and the second electrode thereof is connected to a first electrode of the second switching transistor 113 and the gate electrode of the driving transistor 102.

A gate electrode of the second switching transistor 113 is connected to the second scan line $G_{Bj}$, a first electrode of the second switching transistor 113 is connected to the second electrode of the first switching transistor 103 and the gate electrode of the driving transistor 102, and a second electrode thereof is connected to the power supply line $V_i$.

The gate electrode of the driving transistor 102 is connected to the second electrode of the first switching transistor 103 and the first electrode of the second switching transistor 113, the first electrode of the driving transistor 102 is connected to the power supply line $V_i$, and the second electrode thereof is connected in series with a first electrode of the third switching transistor 114. A control signal 016 is inputted to a gate electrode of the third switching transistor 114, a first electrode of the third switching transistor 114 is connected to the second electrode of the driving transistor 102, and a second electrode of the third switching transistor 114 is connected to one electrode of the light emitting element 101.

One end of the capacitor 104 is connected to the power supply line $V_i$, and the other end is connected to the signal line $S_i$ and $V_i$ through the first switching transistor 103 and the second switching transistor 113, as well as to the gate electrode of the driving transistor 102. Therefore, a signal voltage inputted from the signal line $S_i$ is stored in the capacitor 104, and a voltage between the gate and the source of the driving transistor 102 is retained even after stopping applying a voltage to the signal lines $S_i$.

A configuration of a second scan line driver circuit 115 is shown in FIG. 5C. The operation is much the same as that described in Embodiment 1.

The signal line driver circuit 003 in FIG. 5A comprises a shift register, a buffer, and a sampling circuit. The shift register sequentially outputs a sampling pulse in accordance with a clock signal (S-CLK), a start pulse (S-SP), and a clock inversion signal (S-CLKb). The sampling pulse is amplified in the buffer, and then inputted to the sampling circuit. At the timing of the sampling pulse input, a video signal of the sampling pulse circuit is inputted to the signal lines $S_1$ to $S_x$.

The first scan line driver circuit 004 in FIG. 5A comprises a shift register and a buffer. The shift register sequentially outputs a sampling pulse in accordance with a clock signal ($G_A$-CLK), a start pulse ($G_A$-SP), and a clock inversion signal ($G_A$-CLKb). The sampling pulse is amplified in the buffer, and then inputted to the first scan lines $G_{A1}$ to $G_{Ay}$ to select each of them line by line. A video signal is sequentially inputted from the signal lines $S_1$ to $S_x$ to a pixel controlled by the selected first scan line $G_{An}$. Thus, the light emitting element 101 is brought into a light emitting state, and the sustain period starts.

The second scan line driver circuit 115 in FIG. 5C comprises the shift register 009 and the buffer 010. The shift register 009 sequentially outputs a sampling pulse in accordance with a clock signal ($G_B$-CLK), a start pulse ($G_B$-SP), and a clock inversion signal ($G_B$-CLKb). Then, the sampling pulse is amplified in the buffer 010 and inputted to the second scan lines $G_{B1}$ to $G_{By}$ to select each of them line by line. The second switching TFT 113 is controlled by the selected second scan line $G_{Bn}$, and the light emitting element 101 is brought into a non-light emitting state.

The control signal 016 is inputted to the gate electrode of the third switching TFT 114. A light emitting state and a non-light emitting state are alternated in accordance with a switching of the third switching TFT 114. The light emitting element 101 emits light when the first scan line $G_{Aj}$ is selected, whereas the light emitting element 101 emits no light when the second scan line $G_{Bj}$ is selected. The control signal 016 is necessarily inputted from outside, and may be inputted in synchronism with the clock signal ($G_B$-CLK) of the circuits 007 for applying a scan voltage, or may be branched to be inputted directly. It is preferable that an input frequency to the control signal 016 is equal to or substantially equal to the clock signal of the circuits 007 for applying a scan voltage.

As described in this embodiment, the light emitting element 101 can be controlled more accurately by providing both the third switching TFT 114 for controlling a light emission and a non-light emission of the light emitting element 101 and the switching TFT 113 for controlling a non-light emitting period of the light emitting element 101. In the case where the switching circuit 006 fails in Embodiment 1, it is impossible to control the light emitting element 101 connected to the second scan line $G_{Bj}$ connected to the switching circuit 006 which fails, leading to line defects or bright lines. In this embodiment, however, the switching circuit 006 is not provided and the light emitting element 101 is controlled by the third switching TFT 114 for controlling a light emission and a non-light emission and the switching TFT 113 for controlling a non-light emitting period of the light emitting element 101, therefore, the problem occurred in Embodiment 1 is not caused in this embodiment.

Embodiment 3

The driving method of a light emitting device according to the invention can be applied to various electronic apparatuses such as a video camera, a digital camera, a goggle type display (head mounted display), a navigation system, an audio reproduction device (audio component stereo, car audio and the like), a notebook personal computer, a game machine, a portable information terminal (mobile computer, mobile phone, electronic dictionary and the like), and a device such as a DVD (Digital Versatile Disc) which can reproduce a recording medium and has a display for displaying the reproduced image. Specific examples of these electronic apparatuses are shown in FIGS. 6A to 6C.

Figure 6:
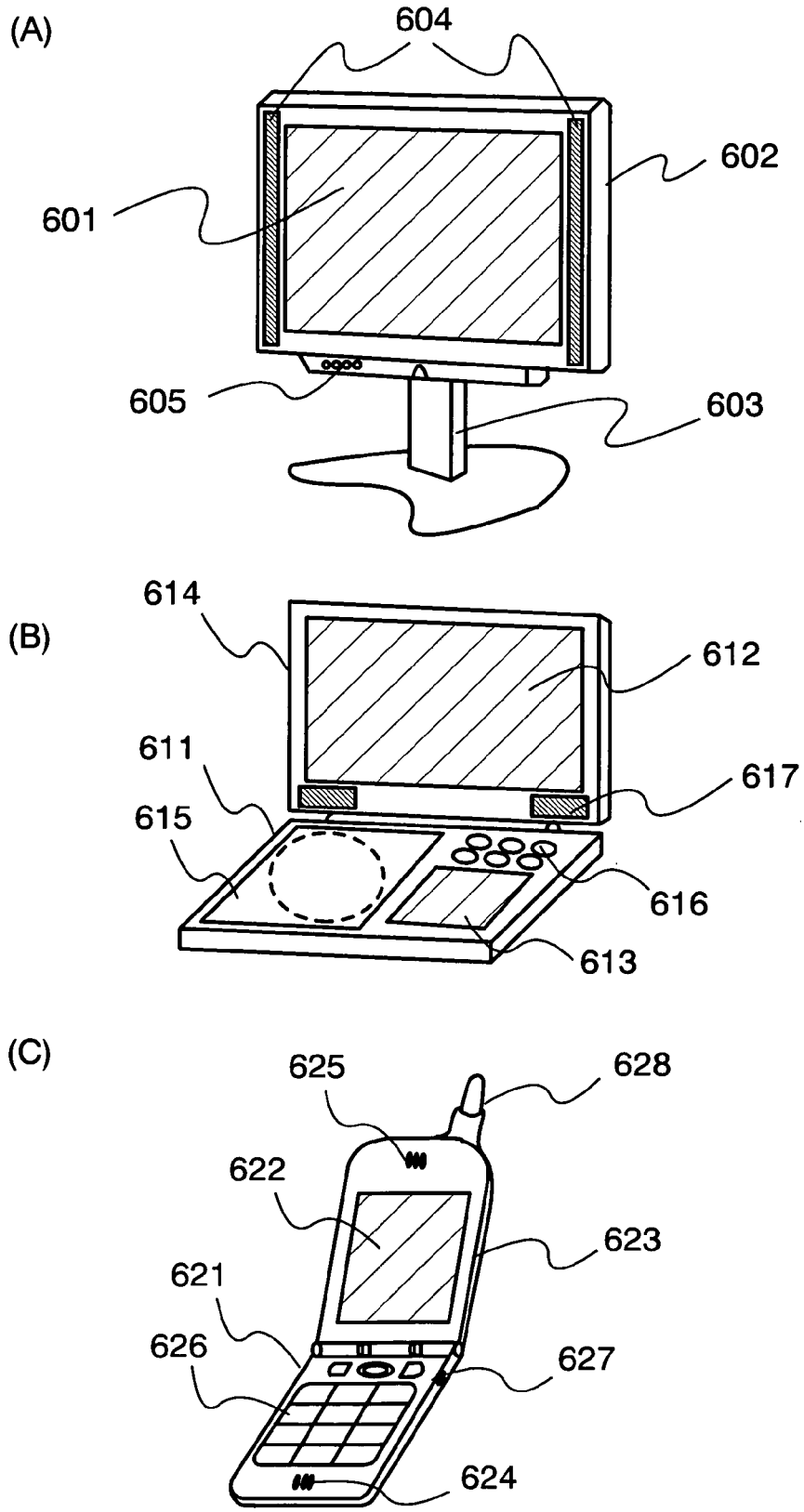
FIG. 6 shows electronic apparatuses to which the driving method of a light emitting device of the invention can be applied.

FIG. 6A shows a light emitting device comprising a display portion 601, a housing 602, a support 603, speaker portions 604, a video input terminal 605 and the like. The invention can be applied to the display portion 601. The light emitting device shown in FIG. 6A can be completed according to the invention. Since the light emitting device uses a self light emitting element, it requires no back light, and thus the display portion can be reduced in thickness. It is to be noted that the light emitting device includes all the display devices for information such as for a personal computer, for television broadcast reception, and for advertisement display.

FIG. 6B shows a portable image display device provided with a recording medium, which comprises a main body 611, a display portion A 612, a display portion B 613, a housing 614, a recording medium reading portion 615, an operation key 616, a speaker portion 617 and the like. The display portion A 612 mainly displays image information whereas the display portion B 613 mainly displays text information. The invention can be applied to both the display portion A 612 and the display portion B 613. In the case where the display portion B 613 displays white letters on a black background, the portable image display device consumes less power. It is to be noted that the portable image display device provided with a recording medium includes a home video game machine and the like. The image display device shown in FIG. 6B can be completed according to the invention.

FIG. 6C shows a mobile phone comprising a main body 621, a display portion 622, a housing 623, an audio input portion 624, an audio output portion 625, an operation key 626, an external connection port 627, an antenna 628 and the like. The invention can be applied to the display portion 622. The mobile phone shown in FIG. 6C can be completed according to the invention.

The aforementioned electronic apparatuses are more likely to be used for displaying information distributed through a telecommunication path such as Internet and a CATV (Cable Television System), and in particular used for displaying moving pictures. The light emitting device according to the invention is suitable for displaying moving pictures since the light emitting material can exhibit a remarkably high response.

The application range of the invention is so wide that it can be applied to electronic apparatuses in all fields, as it is easily expected that a display portion is mounted in electronic apparatuses in all fields toward the realization of a ubiquitous society.

The invention claimed is:

1. A driving method of a light emitting device comprising a first scan line driver circuit for inputting a first signal to a first scan line and a second scan line driver circuit for inputting a second signal to a second scan line wherein the second scan line driver includes a circuit for applying a scan voltage and a NAND circuit electrically connected to the circuit for applying a scan voltage, the method comprising the steps of:

inputting a clock signal into the circuit for applying the scan voltage;

inputting a control signal into the NAND circuit;

turning on a light emitting element when a sustain period starts in accordance with the first signal;

repeatedly switching a conduction state between the light emitting element and a power supply line in synchronized timing with a frequency of the control signal during the sustain period, so that a current is directly applied from the power supply line to the light emitting element; and turning off the light emitting element when the sustain period terminates in accordance with the second signal.

2. The driving method according to claim 1, wherein a frequency of the clock signal is equal to the frequency of the control signal.

3. An electronic apparatus using the driving method of a light emitting device as recited in claim 2.

4. An electronic apparatus using the driving method of a light emitting device as recited in claim 1.

5. The driving method according to claim 1, wherein the light emitting element is flashed with a shorter period than a sustain period which has the shortest lighting time among n sustain periods in a frame period.

6. A driving method of a light emitting device comprising a first scan line driver circuit for inputting a first signal to a first scan line and a second scan line driver circuit for inputting a second signal to a second scan line wherein the second scan line driver includes a circuit for applying a scan voltage and a NAND circuit electrically connected to the circuit for applying a scan voltage, the method comprising the steps of:

inputting a clock signal into the circuit for applying the scan voltage;

inputting a control signal into the NAND circuit;

turning on a light emitting element by imputing a video signal into a driving transistor when a sustain period starts by inputting the first signal to a first switching transistor;

repeatedly switching a conduction state between the light emitting element and a power supply line in synchronized timing with a frequency of the control signal by inputting an output signal of the NAND circuit to a second switching transistor connected to the light emitting element during the sustain period, so that a current is directly applied from the power supply line to the light emitting element; and turning off the light emitting element when the sustain period terminates by inputting the second signal to a third switching transistor.

7. The driving method according to claim 6 wherein a frequency of the clock signal is equal to the frequency of the control signal.

8. An electronic apparatus using the driving method of a light emitting device as recited in claim 7.

9. An electronic apparatus using the driving method of a light emitting device as recited in claim 6.

10. The driving method according to claim 6, wherein each of the driving transistor and the first to third switching transistors is a thin film transistor.

11. The driving method according to claim 6, wherein the light emitting element is flashed with a shorter period than a sustain period which has the shortest lighting time among n sustain periods in a frame period.

* * * * *

UNITED STATES PATENT AND TRADEMARK OFFICE

CERTIFICATE OF CORRECTION

PATENT NO. : 7,573,445 B2
APPLICATION NO. : 10/732602
DATED : August 11, 2009
INVENTOR(S) : Machida It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 445 days.

Delete the phrase "by 445 days" and insert -- by 588 days --

Signed and Sealed this

Thirteenth Day of April, 2010

David J. Kappos

David J. Kappos
*Director of the United States Patent and Trademark Office*